US006903481B2

(12) United States Patent
Habele

(10) Patent No.: US 6,903,481 B2
(45) Date of Patent: Jun. 7, 2005

(54) COMMUTATOR FOR ELECTRIC MOTORS

(75) Inventor: Michael Habele, Waldenbuch (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/471,249

(22) PCT Filed: Feb. 27, 2003

(86) PCT No.: PCT/DE03/00625

§ 371 (c)(1),
(2), (4) Date: Dec. 4, 2003

(87) PCT Pub. No.: WO03/100919

PCT Pub. Date: Dec. 4, 2003

(65) Prior Publication Data

US 2004/0239205 A1 Dec. 2, 2004

(30) Foreign Application Priority Data

May 25, 2002 (DE) ..... 102 23 361

(51) Int. Cl.[7] ..... H01R 39/28
(52) U.S. Cl. ..... 310/219; 310/233; 29/597
(58) Field of Search ..... 310/233, 234, 310/219; 29/596, 597

(56) References Cited

U.S. PATENT DOCUMENTS

| | | | | |
|---|---|---|---|---|
| 3,179,829 A | * | 4/1965 | Worner | 310/235 |
| 3,341,726 A | | 9/1967 | Brinster et al. | |
| 3,452,227 A | * | 6/1969 | Welch | 310/82 |
| 3,532,913 A | * | 10/1970 | Schreiber et al. | 310/234 |
| 3,544,868 A | | 12/1970 | Bates | |
| 3,558,944 A | | 1/1971 | Verge | |
| 3,819,964 A | | 6/1974 | Noodleman | |
| 4,922,164 A | * | 5/1990 | Jacobsen et al. | 310/309 |
| 5,208,502 A | * | 5/1993 | Yamashita et al. | 310/219 |
| 5,949,174 A | * | 9/1999 | Moss et al. | 310/233 |

FOREIGN PATENT DOCUMENTS

| | | | |
|---|---|---|---|
| DE | 2 327 793 | 12/1974 | |
| DE | 43 07 629 A | 9/1994 | |
| DE | 43 28 041 C2 | 6/1995 | |
| DE | 197 52 626 A1 | 6/1998 | |
| GB | 2 046 027 A | 11/1980 | |
| WO | WO 3100919 A1 * | 12/2003 | H01R/39/28 |

OTHER PUBLICATIONS

Patent Abstracts of Japan vol. 1995, No. 06, Jul. 31, 1995 & JP 07 059320, Mar. 3, 1995.

* cited by examiner

*Primary Examiner*—Joseph Waks
(74) *Attorney, Agent, or Firm*—Michael J. Striker

(57) ABSTRACT

The commutator has a cylindrical collector (1), disposed on a motor armature shaft, and electrical-contact means (4, 5), which during one rotation of the collector (1) touch at least two each of a plurality of commutator laminations (3) that are present on the collector (1) and thereby establish an electrical connection between the applicable commutator laminations and external current connections (21, 22).

Figure 1:
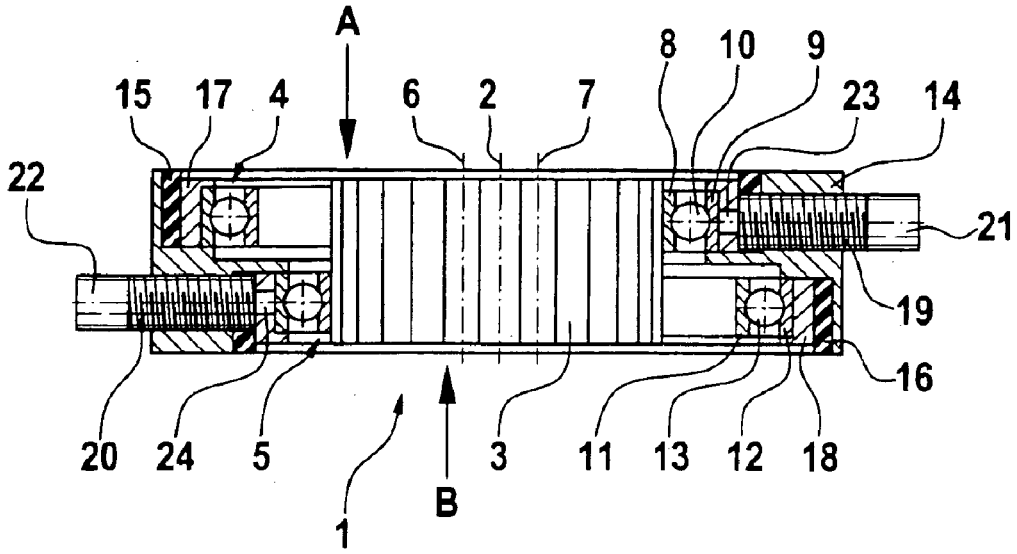

The electrical-contact means becomes especially low-wearing because the electrical-contact means comprise at least two electrically conductive cylinders (4, 5) disposed in line with one another in the axial direction of the collector (1), the longitudinal axes (6, 7) are parallel to the longitudinal axis (2) of the collector (1); and that the at least two cylinders (4, 5) are placed relative to the collector (1) in such a manner and have a diameter such that the collector (1), in its rotation, rolls over the inside faces (8) or the outside faces of the at least two cylinders (4, 5), and in the process each of the cylinders (4, 5) is touched always by only one lamination (3) of the collector (3).

9 Claims, 2 Drawing Sheets

COMMUTATOR FOR ELECTRIC MOTORS

PRIOR ART

The present invention relates to a commutator for electric motors, which has a cylindrical collector disposed on a motor armature shaft and has electrical-contact means, which during one rotation of the collector touch at least two each of a plurality of commutator laminations that are present on the collector and thus establish an electrical connection between the applicable commutator laminations.

One such commutator, in which carbon brushes slide on the laminations of the collector and thus transmit a direct current into the armature windings, is known for instance from German Patent Disclosure DE 197 52 626 A1. Such commutators equipped with carbon brushes are typically used for direct-current motors or universal motors. Such commutators have the disadvantage of being highly vulnerable to wear, so that the service life of an electric motor is reduced considerably unless the carbon brushes are replaced. The replaceability of the carbon brushes necessitates relatively high engineering effort and expense. As an alternative solution for such high-wear mechanical commutators, there are electric machines that are commutated purely electrically. The electronic circuits required for the electric commutation are relatively complicated and thus cost-intensive.

It is therefore the object of the invention to disclose a commutator for electric motors of the type defined at the outset that functions purely mechanically yet nevertheless is very low-wear.

ADVANTAGES OF THE INVENTION

The aforementioned object is attained with the characteristics of claim 1. The collector of the motor has electrical-contact means which during one rotation of the collector each touch at least two of a plurality of commutator laminations present on the collector and thus establish an electrical connection between the applicable commutator laminations and external current connections. According to the invention, the electrical-contact means comprise at least two electrically conductive cylinders, disposed in line with one another in the axial direction of the collector, whose longitudinal axes are parallel to the longitudinal axis of the collector. The at least two cylinders are placed in such a way relative to the collector and have a diameter such that the collector in its rotation rolls over the inside faces or outside faces of the at least two cylinders, and in the process each of the cylinders present is only ever touched by one lamination of the collector. Because the collector rolls with its laminations on the cylinders, and there is no sliding contact between the two, the parts belonging to the commutator are subject to only extremely slight wear. In a motor equipped with such a commutator, no replacement of parts, as is the case with a commutator that has carbon brushes, is necessary over the entire service life of the commutator. Moreover, in the mechanical commutator of the invention, the likelihood of failure is even less than in an electrically commutated motor, since electrical components of the commutation circuit are subject to a certain likelihood of failure.

Advantageous refinements and embodiments of the invention are disclosed in the dependent claims.

One advantageous embodiment of the electrically conductive cylinders provides that they are eccentrically supported relative to the longitudinal axis of the collector.

In a first embodiment, the electrically conductive cylinders are embodied as roller bearings, each with one inner ring and one outer ring. The roller bearings surround the collector, and the inner rings of the roller bearings over which the collector rolls are rotatably supported, and the outer rings are fixed. In a second embodiment, the electrically conductive cylinders are again embodied as roller bearings, each with one inner ring and one outer ring. In this case, however, the roller bearings are disposed in the interior of the collector, and the outer rings of the roller bearings over which the collector rolls are rotatably supported, while the inner rings are fixed.

Means are provided which establish an electrical connection between the fixed inner rings or outer rings of the roller bearings and external current connections. The means for the electrical connection between the fixed outer rings and inner rings of the roller bearings and the external current connections preferably comprise pins that can be screwed from outside through one or more recesses that fix the outer rings and inner rings, so that the ends of the pins abut against the outer rings and inner rings.

Because the electrically conductive cylinders are resiliently supported in the radial direction relative to their longitudinal axis, asymmetries resulting from production tolerances of the collector can be compensated for in a simple way.

It is advantageous that the pins that abut against the outer rings and inner rings of the electrically conductive cylinders and establish an electrical contact press the cylinders against the collector, so that the pins simultaneously perform both an electrical and a mechanical function.

DRAWING

Figure 2:
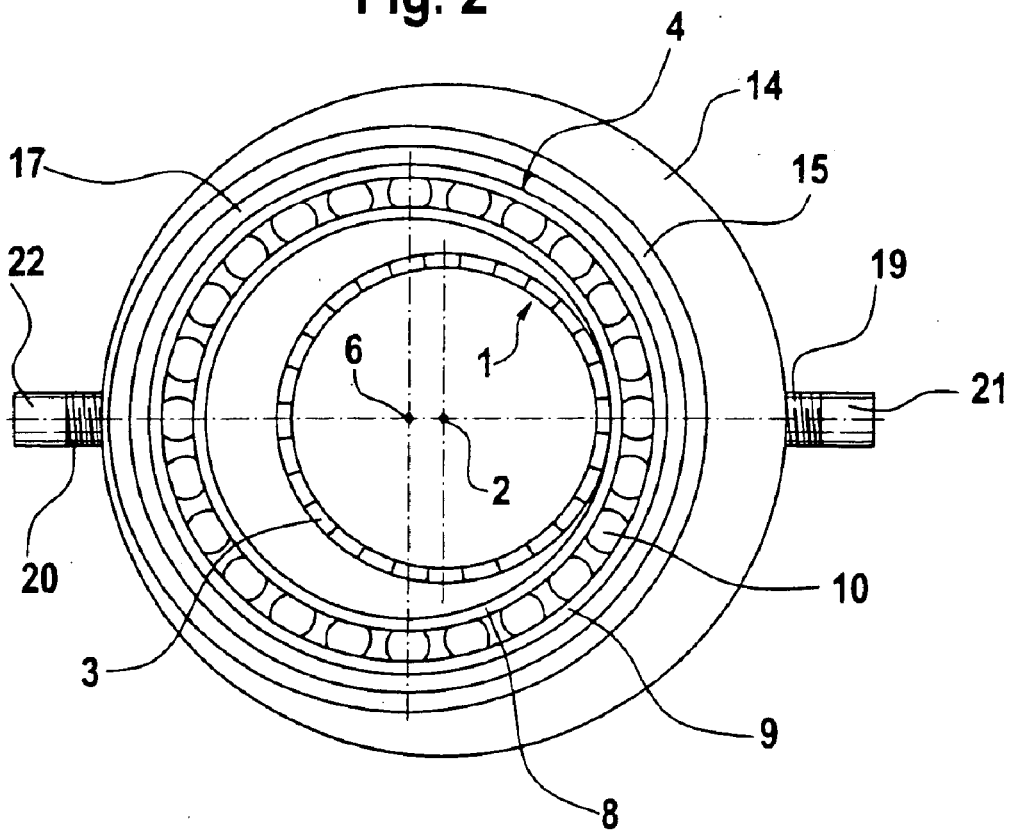

The invention is described in further detail below in terms of several exemplary embodiments shown in the drawing. Shown are:

FIG. 1, a longitudinal section through a commutator with two cylinders surrounding the collector;

FIG. 2, a front view and

Figure 3:
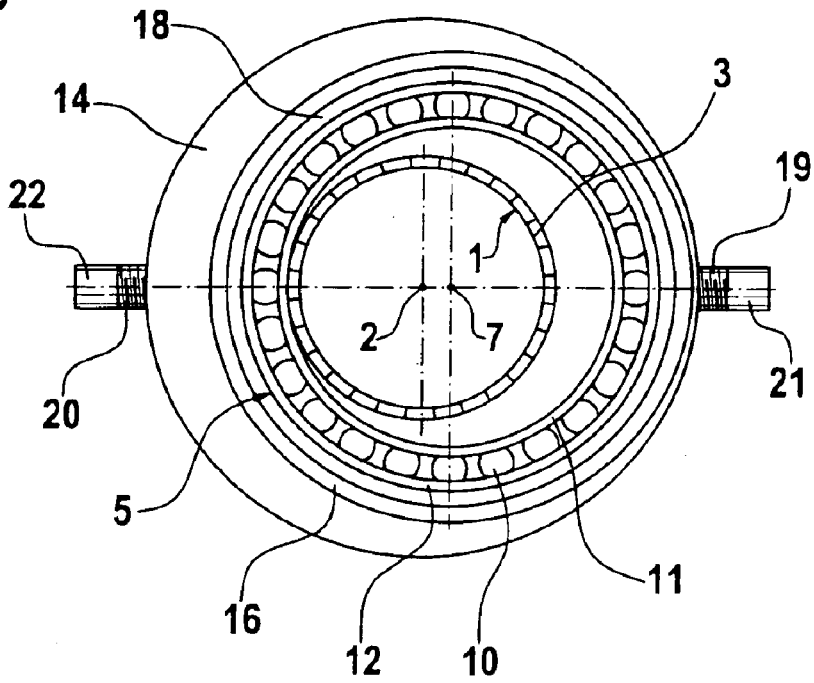

FIG. 3, a back view of the commutator shown in FIG. 1; and

Figure 4:
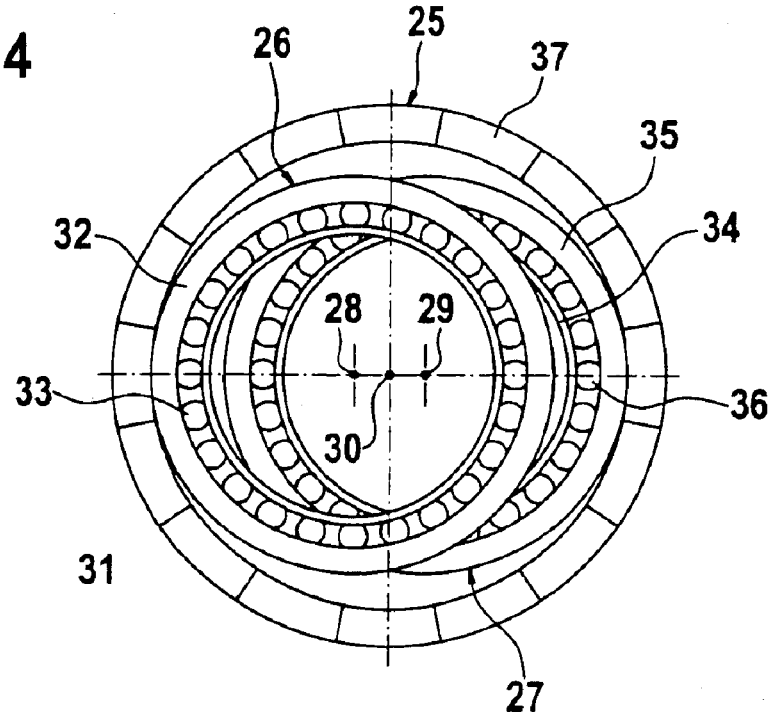

FIG. 4, a front view of a commutator, with two cylinders disposed inside the collector.

DESCRIPTION OF EXEMPLARY EMBODIMENTS

FIG. 1 shows a longitudinal section through a commutator of an electric motor, which for example is a direct-current motor or a universal motor. The commutator has a collector 1, which is supported rotatably about a longitudinal axis 2; this longitudinal axis coincides with the axis of rotation of the rotor, not shown in the drawing and receiving a plurality of armature windings, of the electric motor. The collector 1 has a plurality of laminations 3 on its outer circumference in a known manner, and these laminations are electrically connected to the armature windings and by way of which a current is delivered to the armature windings. The means with which one or more laminations 3 of the collector 1 are supplied with a current and with which the current is drawn again from one or more other laminations 3 of the collector 1 are described hereinafter. These contact means that deliver and draw current can be seen from the cross section through the commutator shown in FIG. 1; the structure of the contact means is also clearly illustrated in the front view A in FIG. 2 and the back view B of the commutator of FIG. 3.

The contact means comprise two electrically conductive cylinders 4 and 5, disposed in line with one another in the axial direction of the collector 1. The electrically conductive cylinder 4 is supported rotatably about a longitudinal axis 6, and the electrically conductive cylinder 5 is supported rotatably about a longitudinal axis 7; the two longitudinal axes 5 and 6 of the two cylinders 4 and 5 are eccentric relative to the longitudinal axis 2 of the collector 1. The two longitudinal axes 6 and 7 of the two electrically conductive cylinders 4 and 5 are offset by the same spacing from the longitudinal axis 2 of the collector 1.

The electrically conductive cylinder 4 is embodied as a roller bearing, with one inner ring 8 and one outer ring 9, and between the inner ring 8 and the outer ring 9 there are balls, rollers or needles 10, which enable mutual rotation of the inner ring 8 and outer ring 9 about the common longitudinal axis 6. The electrically conductive cylinder 5 is constructed in the same way as the electrically conductive cylinder 4. It too comprises an inner ring 11, an outer ring 12, and balls, rollers or needles 13 supported between them.

The two cylinders 4 and 5 in line with one another in the axial direction are retained by a housing 14 concentrically surrounding the collector 1. The housing 14 preferably comprises an electrically insulating material. The outer rings 9 and 12 of the two electrically conductive cylinders 4 and 5 are fixed in stationary fashion in the housing 14. The two electrically conductive cylinders 4 and 5 are resiliently supported in the housing 14 in the radial direction relative to their longitudinal axes 5 and 6. The resilient support of the two cylinders 4 and 5 can be effected for instance by means of a rubber ring 15 and 16, respectively, that is introduced between the outer ring 9 and 12 of the cylinder 5 and 6, respectively, and the inner wall of the housing 14. The resilient rings 15 and 16 can also comprise some other elastic material, instead of rubber. Preferably, between each outer ring 9 and 12 of the respective cylinder 4 and 5 and the rubber ring 15 and 16 surrounding it, a contact ring 17 and 18, which comprises an electrically conductive material, is also inserted.

As described below, the contact rings 17 and 18 resting on the outer rings 9 and 12 of the two cylinders 4 and 5 electrically connect contact pins 19 and 20, which deliver current and draw it, to the cylinders 4 and 5. The contact pin 19 is screwed from outside into the housing 4 perpendicular to the longitudinal axis 6 of the electrically conductive cylinder 4. Its end protruding out of the housing 14 is embodied as a contact lug 21, so that the line from a current source can be connected there. The end of the contact pin 19 pointing into the interior of the housing 14 has a tapered shoulder 23, which is passed through the contact ring 17 and abuts against the outer ring 9 of the cylinder 4. A flow of current is thus possible via the contact pin 19, the outer ring 9, the balls, rollers or needles 10, and the inner ring 8 of the cylinder 4. The other contact pin 20 is constructed in the same way as the contact pin 19 described just above. On its end protruding out of the housing 14, the contact pin 20 has a contact lug 22, and with its end protruding into the housing, it is provided with a tapered shoulder 24 that is passed through the contact ring 18 and abuts against the outer ring 12 of the cylinder 5.

From the two front views shown in FIGS. 2 and 3 in the direction A and the direction B of the commutator, it can be seen that the diameter of the inner rings 8 and 11 of the two cylinders 4 and 5 are to be selected relative to the diameter of the collector 1 such that the inner ring 8 and 11 of the cylinder 4 and 5, respectively, each touches only one lamination of the collector 1. Specifically, the inner rings 8 and 11 of the two cylinders 4 and 5 each touch diametrically opposed laminations of the collector 1. Via one of the two cylinders 4 or 5, a lamination 3 of the collector 1 is supplied with a current, and via the other of the two cylinders 4 or 5, a current is drawn from another lamination of the collector 1. With the contact pins 19 and 20 described above, the electrically conductive cylinders 4 and 5 can be pressed onto the laminations 3 of the collector 1, counter to the spring forces generated by the rubber rings 15 and 16, by means of being screwed more or less deeply into the housing 14. If the collector connected to the rotor of the motor is rotating about its longitudinal axis 2, then the laminations 3 roll over the current-carrying inner rings 8 and 11 of the two eccentrically disposed cylinders 4 and 5. Because the inner rings 8 and 11 can be made to rotate about the longitudinal axes 6 and 7 relative to the outer rings 9 and 12 of the two cylinders 4 and 5, the aforementioned rolling motion of the laminations 3 of the collector 1 on the inner rings 8 and 11 comes about, and as a result a considerably lower-wear rolling contact is formed, compared to a sliding contact (as in the case of a carbon brush contact).

While in the exemplary embodiment described above, only two laminations each of the collector 1 are contacted by the respective cylinders 4 and 5—one lamination for current input and the other lamination for current output—it is also possible for more than only two electrically conductive cylinders in line with one another to be provided, if more laminations of the collector are provided for delivering and drawing current.

In the exemplary embodiment of a commutator shown in FIGS. 1, 2 and 3, the collector 1 rolls on the inner rings 8 and 11 of the two cylinders 4 and 5; that is, the two cylinders 4 and 5 have a greater diameter than the collector 1, so that the two cylinders 4 and 5 surround the collector 1. As can be seen from FIG. 4, in a reversal of the above example, the collector 25 can surround the electrically conductive cylinders 26 and 27. FIG. 4 shows a front view of a collector 25 with two electrically conductive cylinders 26 and 27, disposed in its interior, whose longitudinal axes 28 and 29 extend parallel to the longitudinal axis 30 of the collector 25 and are eccentrically offset from it. For the sake of simplicity, neither the housing of the commutator nor the supporting and electrical-contact means for the two electrically conductive cylinders 26 and 27 have been shown in FIG. 4. Just as in the previous exemplary embodiment above, the electrically conductive cylinder 26 comprises an inner ring 31, and outer ring 32, and balls, rollers or needles 33 supported between them, and the electrically conductive cylinder 27 comprises an inner ring 34, an outer ring 35, and balls, rollers or needles 36 supported between them. The respective inner rings 31 and 34 of the two electrically conductive cylinders 26 and 27 are fixed, while the outer rings 32 and 35 are rotatable relative to the inner rings 31 and 34 about the axes 28 and 29 of the electrically conductive cylinders 26 and 27. In this exemplary embodiment of the commutator, the laminations 37 of the collector 25 roll over the outer rings 32 and 35 of the two electrically conductive cylinders 26 and 27. The current input and output into and out of the two electrically conductive cylinders 26 and 27 is once again, although not shown in FIG. 4, done by means of contact pins, which are brought into connection with the fixed inner rings 31 and 34 of the electrically conductive cylinders 26 and 27.

By changing the current flow direction into or out of the two cylinders 4 and 5, or 26 and 27, a switchover can be made between counterclockwise and clockwise rotation of the motor. In addition, the motor with the electrically conductive cylinders 4, 5 or the electrically conductive cylinders 26, 27 can be braked in a very simple way, specifically in that the outer rings 9, 12 and inner rings 31, 34 respectively rolling on the laminations 3 and 37 of the collector 1 and 25 are braked or are rotated in different directions.

What is claimed is:

1. A commutator for electric motors, which has a cylindrical collector (1, 25) disposed on a motor armature shaft and has electrical-contact means (4, 5, 26, 27), which during one rotation of the collector (1, 25) touch at least two each of a plurality of commutator laminations (3, 37) that are present on the collector (1, 25) and thus establish an electrical connection between the applicable commutator laminations (3, 27) and external current connections (21, 22), characterized in that the electrical-contact means comprise at least two electrically conductive cylinders (4, 5, 26, 27) disposed in line with one another in the axial direction of the collector (1, 25), the longitudinal axes (6, 7, 28, 29) are parallel to the longitudinal axis (2, 30) of the collector (1, 25); and that the at least two cylinders (4, 5, 26, 27) are placed relative to the collector (1, 25) in such a manner and have a diameter such that the collector (1, 25), in its rotation, rolls over the inside faces (8, 11) or the outside faces (9, 12) of the at least two cylinders (4, 5, 26, 27), and in the process each of the cylinders (4, 5, 26, 27) is touched always by only one lamination (3, 37) of the collector (1, 25).

2. The commutator of claim 1, characterized in that the electrically conductive cylinders (4, 5, 26, 27) are supported eccentrically relative to the longitudinal axis (2, 30) of the collector (1, 25).

3. The commutator of claim 1, characterized in that the electrically conductive cylinders (4, 5) are embodied as roller bearings, each with one inner ring (8, 11) and one outer ring (9, 12); that the cylinders (4, 5) surround the collector (1); and that the inner rings (8, 11) of the cylinders (4, 5) over which the collector (1) rolls are supported rotatably and fix the outer rings (9, 12).

4. The commutator of claim 3, characterized in that means (19, 20) are provided, which establish an electrical connection between the fixed inner rings (8, 11) or outer rings (32, 35) of the cylinders (4, 5, 26, 27, respectively) and external current connections (21, 22).

5. The commutator of claim 4, characterized in that the means for electrical connection between the fixed outer rings and inner rings (9, 12) of the cylinders (4, 5) and the external current connections (21, 22) comprise pins (19, 20), which can be screwed from outside through one or more recesses (14, 17, 18) that fix the outer rings and inner rings (9, 12), so that the ends (23, 24) of the pins abut against the outer rings and inner rings (9, 12).

6. The commutator of claim 5, characterized in that the pins (19, 20) that abut against the outer rings and inner rings (9, 12) of the electrically conductive cylinders (4, 5) and establish an electrical contact press the cylinders (4, 5) against the collector (1).

7. The commutator of claim 1, characterized in that the electrically conductive cylinders (26, 27) are embodied as roller bearings, each with one inner ring (31, 34) and one outer ring (32, 35); that the cylinders (26, 27) are disposed in the interior of the collector (25); and the that outer rings (32, 35) of the cylinders (26, 27) over which the collector (25) rolls are rotatably supported and fix the inner rings (31, 34).

8. The commutator of claim 1, characterized in that the electrically conductive cylinders (4, 5) are supported resiliently in the radial direction relative to their longitudinal axis (6, 7).

9. The commutator of claim 1, characterized in that means (19, 20) are provided, which press the electrically conductive cylinders (4, 5) against the collector (1).

* * * * *